US005720574A

United States Patent [19]

Barella

[11] Patent Number: 5,720,574

[45] Date of Patent: Feb. 24, 1998

[54] CONTAMINANT ABSORBING DRAINAGE TROUGH APPARATUS

[75] Inventor: John Barella, Petaluma, Calif.

[73] Assignee: Kristar Enterprises, Inc., Santa Rosa, Calif.

[21] Appl. No.: 552,002

[22] Filed: Nov. 2, 1995

[51] Int. Cl.[6] ..... E02B 13/00; E03F 1/00

[52] U.S. Cl. ..... 405/52; 52/20; 210/164; 404/4; 404/25; 405/118

[58] Field of Search ..... 405/52, 118–121; 404/2, 4, 5, 25, 26; 210/163, 164, 170, 165; 52/20

[56] References Cited

U.S. PATENT DOCUMENTS

| | | | |
|---|---|---|---|
| 1,749,878 | 3/1930 | Fleming | 210/165 |
| 3,774,765 | 11/1973 | Kane et al. | 210/164 |
| 4,136,010 | 1/1979 | Pilie et al. | 404/25 X |
| 4,418,432 | 12/1983 | Vidal | 210/163 X |
| 4,419,232 | 12/1983 | Arntyr et al. | 404/5 X |
| 4,776,722 | 10/1988 | Gaudin | 404/25 |
| 5,284,580 | 2/1994 | Shyh | 404/4 X |
| 5,511,904 | 4/1996 | Van Egmond | 405/52 |

*Primary Examiner*—Dennis L. Taylor
*Attorney, Agent, or Firm*—Larry D. Johnson

[57] ABSTRACT

A structure for use with water drainage inlets includes an outside wall portion, a perforated bottom portion, and an inside wall portion. The outside wall, bottom, and inside wall together define a trough for retention of a replaceable filter media. The trough is installed on the inside surface of a drainage structure so that drainage water that would normally flow directly through the drainage structure is caused instead to flow through the filter media, thereby removing undesirable materials that may be carried in the water, while permitting the water itself to pass through essentially unimpeded to the ultimate drainage location.

6 Claims, 6 Drawing Sheets

CONTAMINANT ABSORBING DRAINAGE TROUGH APPARATUS

BACKGROUND OF THE INVENTION

1. Field of the Invention

This application relates generally to drainage structures and associated hardware, and more specifically to an improved contaminant absorbing trough apparatus for use in connection with new or existing water drainage inlets to collect contaminants such as hydrocarbons and the like while continuing to permit the undisturbed passage of the drainage water.

2. Description of the Prior Art

Drainage structures such as drainage inlets for sidewalks, roads and parking lots are well known and in widespread use. Typically, such structures merely provide a drainage path for the removal of rainwater, irrigation water, or the like that would otherwise accumulate on the ground surface. However, the water thus drained from the surface by these drainage structures is often simply carried to a lake, stream or other body of water. Thus, undesirable and even toxic materials that may have collected on the surface, such as oil, fuel, antifreeze and the like, are carried with the drainage water and to the ultimate drainage location.

SUMMARY OF THE INVENTION

The contaminant absorbing drainage trough apparatus of this invention provides an improved structure for use in connection with new or existing water drainage inlets that enables the collection of contaminants such as hydrocarbons and the like, while still permitting the essentially undisturbed passage of the drainage water. The inventive drainage trough apparatus includes an outside wall portion which may include a perpendicular support flange, a mesh or perforated bottom portion, and an inside wall portion which may include an oblique upper panel portion. The outside wall portion, perforated bottom portion, and inside wall portion together define a channel or trough area for retention of a removable and replaceable filter media such as a quantity of loose filter material, a filter media-filled permeable "sock", or a self-contained filter "cartridge" with permeable top and bottom surfaces. Loose filter media material may be covered with a media restrainer such as a screen or bracket.

The trough apparatus is installed on the inside surface of a drainage structure so that drainage water that would normally flow directly through the drainage structure is caused instead to flow through the filter media. This removes undesirable and toxic materials that may be carried in the water, while permitting the water itself to pass through essentially unimpeded to the ultimate drainage location.

The inventive trough system is designed to be adjusted to fit the numerous sizes of square or rectangular drainage inlets such as flat grated type inlets, curb opening type inlets, and combination curb opening and gutter grate type inlets. The inventive system can be applied to round inlets as well.

For square or rectangular inlets with grates, the system consists of straight rails and corner sections. The rail sections can be cut to the appropriate length and connected to the corner sections forming a trough "ring". The inlet grate is removed and the ring is placed inside of the inlet, with the flanges of the rail and corner sections resting on the horizontal bearing surfaces that typically exist along the top edge of the inlet. Alternatively, the flanges may be trimmed to the proper width of the grate seat, or removed entirely on inlet sides that do not have grate bearing surfaces. In these installations, the outside walls of the rail and corner sections can be directly secured to the inside walls of the sides of the inlet structure, using clips, bolts, or any other fastening method. The inventive apparatus may also be used where the drainage inlet has a curb opening only (i.e., no grate). In such installations, a straight rail section with end caps (instead of corner sections) can be placed inside the inlet across the flowline of the curb opening.

For round inlets, the trough apparatus may have the same or similar cross section, but simply be circular in shape. The most common sizes are expected to be 24", 18" and 12" inside diameters.

The filter media material that can be used is preferably an approved collecting agent, or any other filter media which allows water to flow more or less directly through the media while capturing oil and other contaminants. For example, an inert inorganic blend of amorphous siliceous material containing sodium, potassium and aluminum silicates, in variable composition, has been shown to be effective. The filter media is placed in the bottom of the trough, above the perforations in the trough, and can be retained there if necessary with clips or other retaining mechanisms to keep the filter from floating or otherwise moving. The filter media may be replaced on a periodic schedule (e.g., every six months), or otherwise as needed.

Besides the adjustability of this product, another key benefit is that a clear opening of the drainage inlet is maintained to allow for maintenance and inspection of the inlet, as well as allow for high drainage flows.

The inventive trough apparatus can be made of many suitable materials, such as sheet metal. Alternatively, high density polyethylene (HDPE) may allow for easier installation as well as protection from any chemical attack.

DETAILED DESCRIPTION OF A PREFERRED EMBODIMENT

Figure 1:
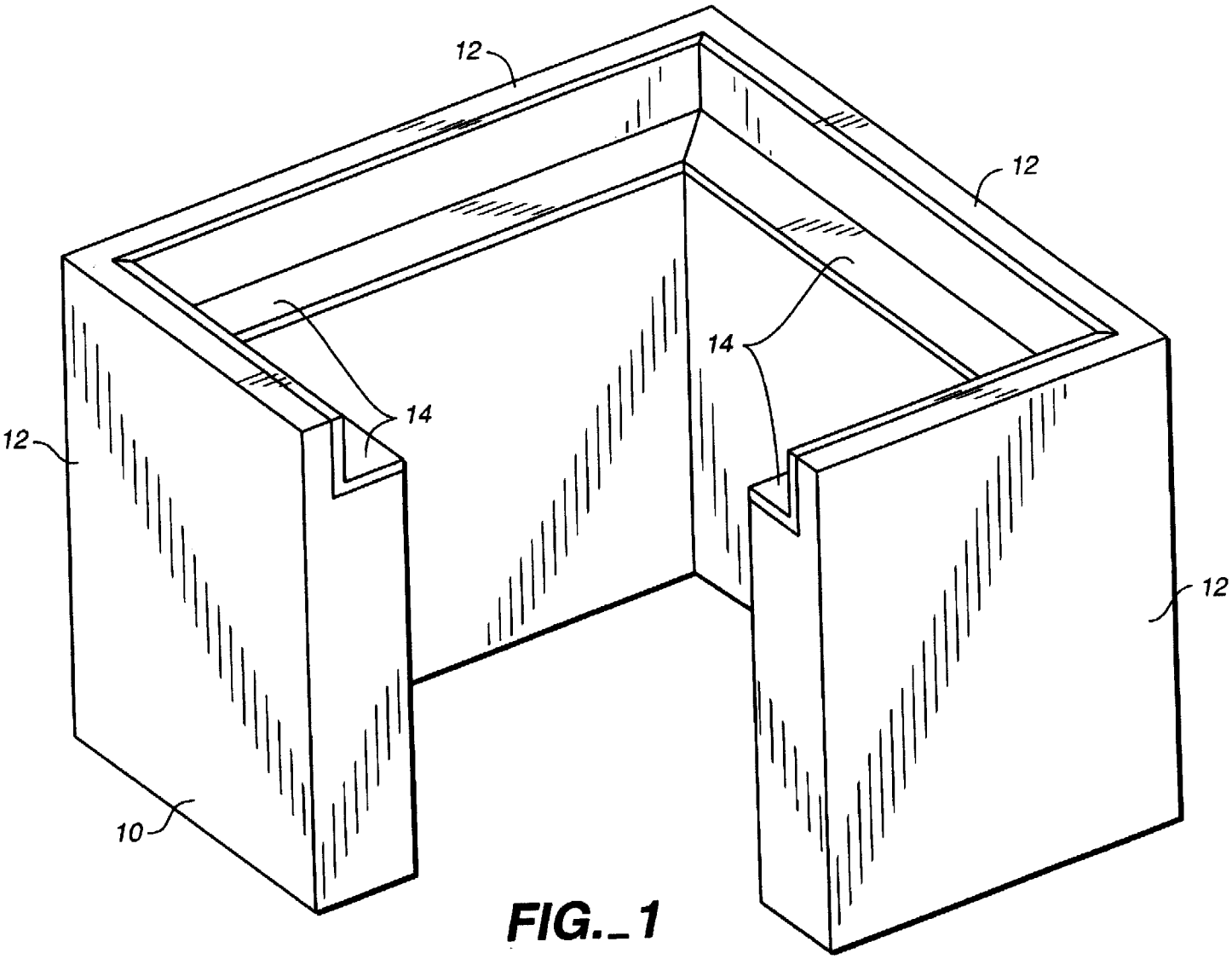
FIG. 1 is a cutaway perspective view of a flat grated inlet structure.

FIG. 1 is a cutaway perspective view of a typical flat grated inlet structure 10 (with the grate removed), having four sides 12 each including horizontal bearing surfaces 14 for support of the grate.

Figure 2:
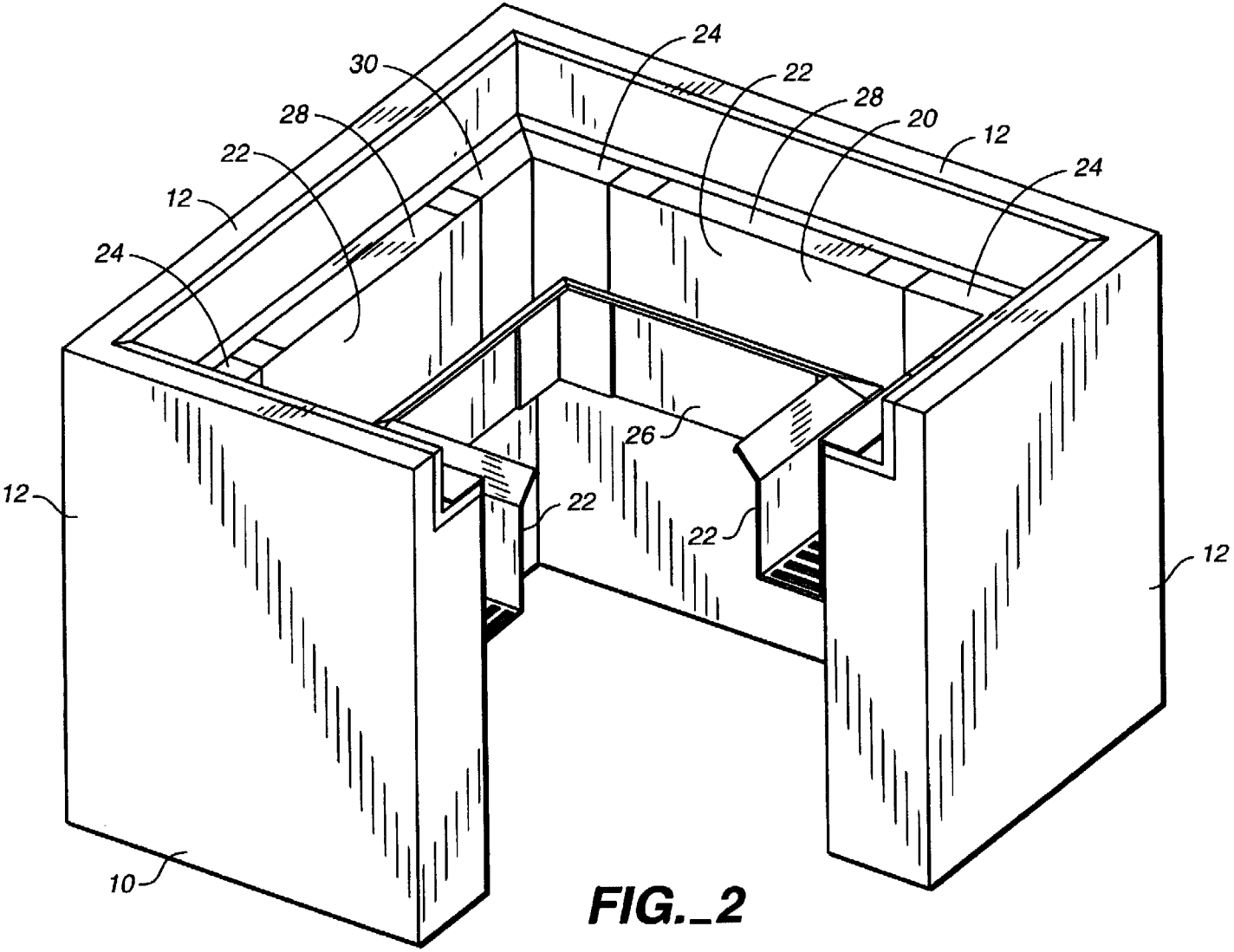
FIG. 2 is a view of the inlet structure of FIG. 1 with a drainage trough apparatus of this invention installed therein.

FIG. 2 is a cutaway perspective view of the flat grated inlet 10 of FIG. 1 with a drainage trough apparatus 20 of this invention having been installed along the inside perimeter of the four sides 12 of the inlet 10. The drainage trough apparatus 20 includes a series of rail sections 22 connected by a series of corner sections 24 to form a trough ring 26 around the inside perimeter of the sides 12 of the grated inlet. The rail sections 22 and corner sections 24 each include flange portions 28, 30, respectively, adapted to ride on the grated inlet horizontal bearing surfaces 14.

Figure 3:
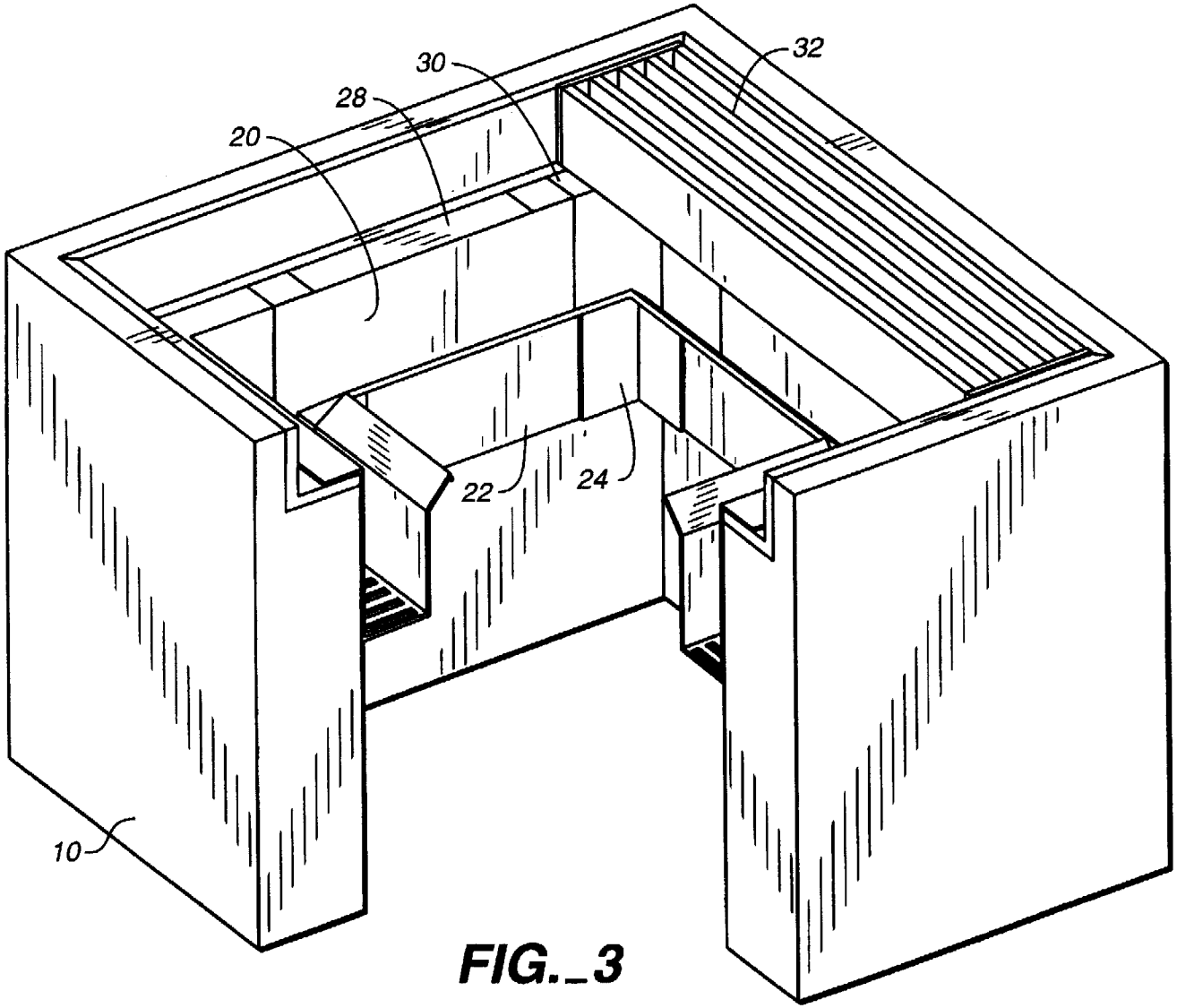
FIG. 3 is a view of the structure of FIG. 2 with a portion of inlet grate.

FIG. 3 is a cutaway perspective view of the flat grated inlet 10 with installed drainage trough apparatus 20 of FIG.

2. This view illustrates a portion of a typical inlet grate 32 having been placed into the inlet 10 on top of the flange portions 28, 30 of the rail sections 22 and corner sections 24.

Figure 4:
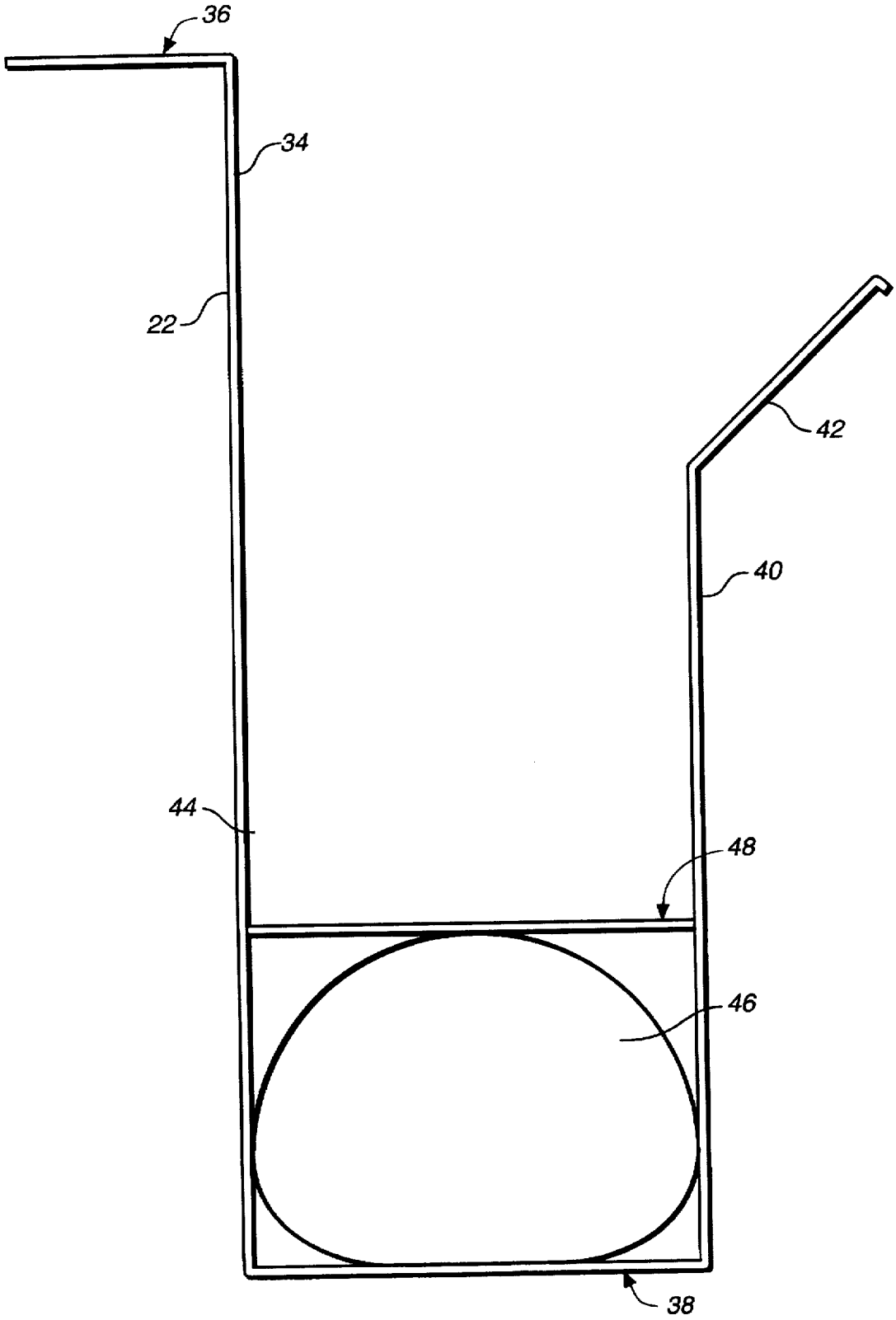
FIG. 4 is a side elevation cross-sectional view of a rail section of this invention.

FIG. 4 is a side elevation cross-sectional view of a rail section 22 of the drainage trough apparatus of this invention, illustrating its component parts including an outside wall portion 34 bearing a perpendicular support flange 36, a mesh or perforated bottom portion 38, and an inside wall portion 40 bearing an oblique upper panel portion 42. The outside wall portion 34, perforated bottom portion 38, and inside wall portion 40 together define a channel or trough area 44 suitable for retention of a removable and replaceable filter media such as a quantity of loose filter material 46. This filter material may be covered with a media restrainer such as a bracket or screen 48.

The overall dimensions of the rail section may of course vary, but may be on the order of eight inches high by three inches wide. The perforations in the bottom portion may also take many forms, but may simply consist of a screen or periodically spaced openings.

The support flange 36 may be removed from the outside wall 34 to enable installation in drainage structures that do not provide a horizontal bearing surface, as described supra. In such installations, it may be appropriate to place a gasket or other seal along the upper edge of the outside wall, to reduce leakage of drainage water behind the outside wall and thus around the trough and filter media member.

Figure 5:
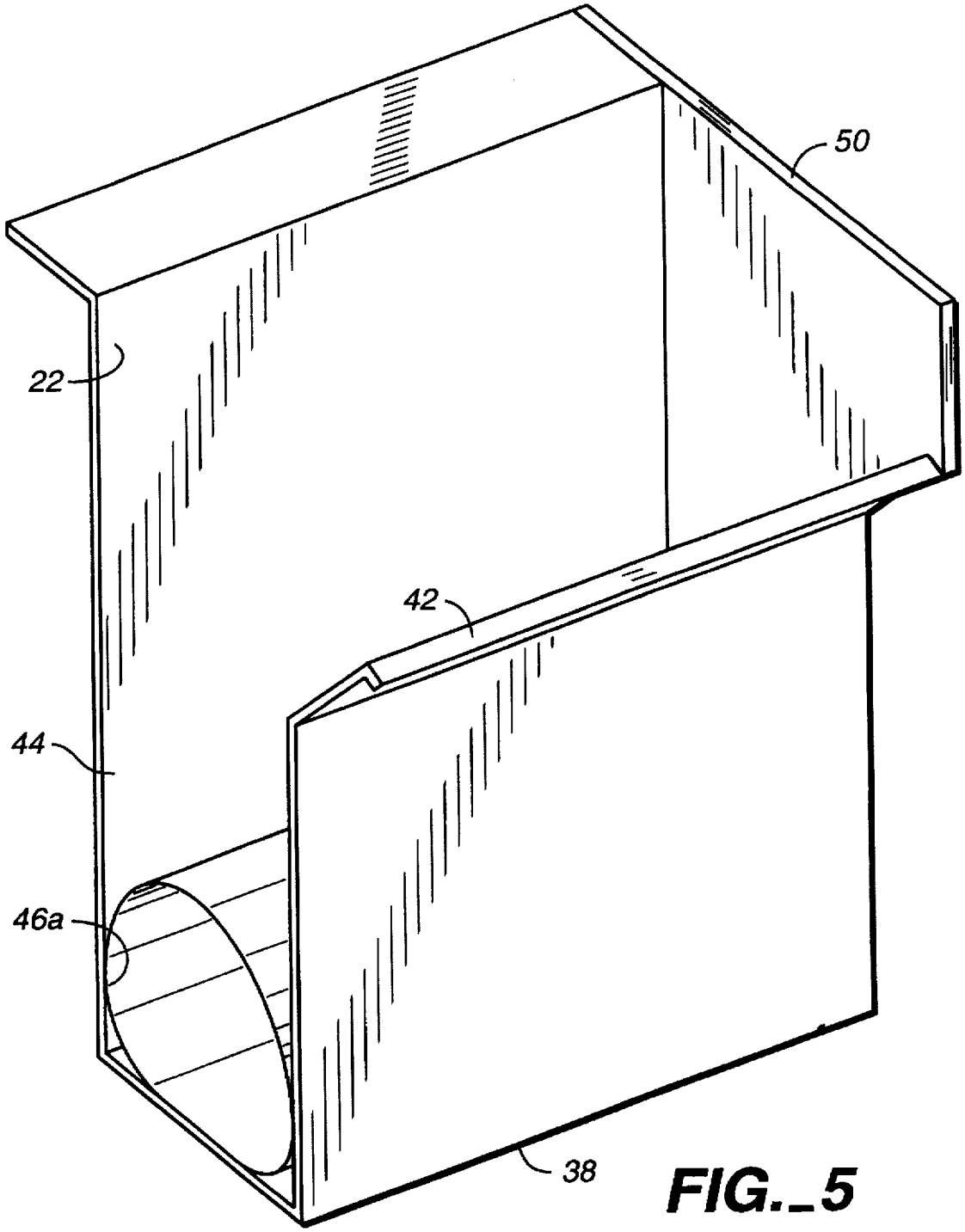
FIG. 5 is a cutaway perspective view of a portion of a rail section.

FIG. 5 is a cutaway perspective view of a portion of a rail section 22 of the drainage trough apparatus of this invention, illustrating a sock-type filter media member **46*a* resting in the trough 44 formed above the perforated bottom portion 38, and terminating in an end cap 50. The oblique upper panel portion 42** may serve to enhance collection of drainage water entering the trough that would otherwise bypass the limited width of the trough, acting, essentially, as a "funnel".

Figure 6:
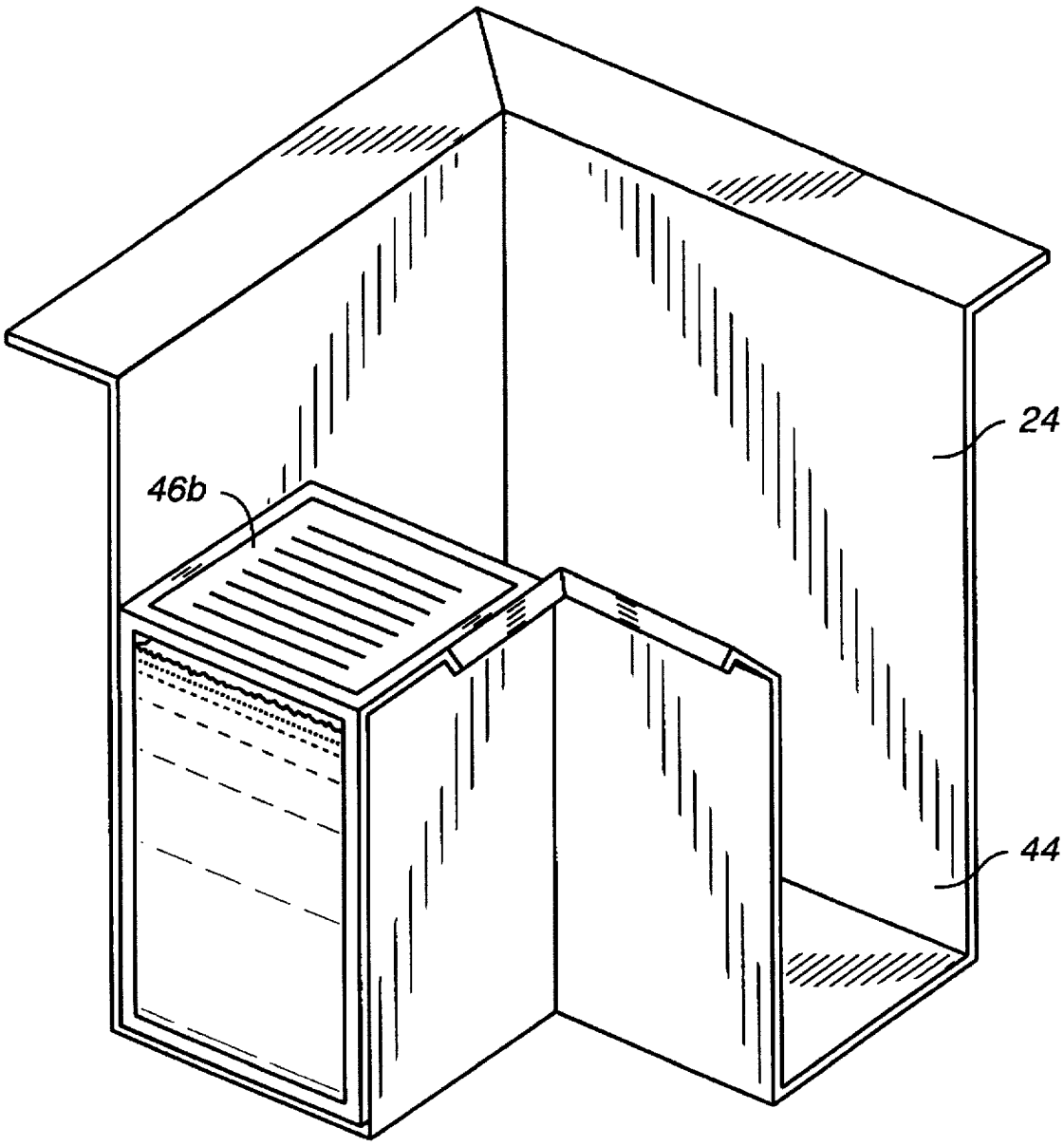
FIG. 6 is a perspective view of a corner section.

FIG. 6 is a perspective view of a corner section 24 of the drainage trough apparatus of this invention illustrating a cartridge-type filter media member **46*b* resting in the trough 44**. This corner section may be of any angle (e.g., ninety degrees as here) to fit into any shape or dimension of drainage structure. The "corner" could also be rounded or otherwise curved to fit into circular or other drainage structures.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and their legal equivalents.

What is claimed as invention is:

1. A contaminant absorbing drainage trough apparatus for use with a water drainage structure, said water drainage structure having an inside surface, said drainage trough apparatus enabling collection of contaminants while permitting passage of drainage water through said drainage structure, said drainage trough apparatus comprising:

a non-perforated outside wall portion;

a perforated bottom portion connected to said outside wall portion;

a non-perforated inside wall portion connected to said perforated bottom portion;

a trough portion defined by said outside wall portion, perforated bottom portion, and inside wall portion; and a filter media portion removably placed in said trough portion, wherein when said trough apparatus is installed on the inside surface of the drainage structure so that drainage water that would normally flow directly through the drainage structure is caused instead to flow through said filter media portion, said filter media portion removes contaminants that may be carried in the water, while permitting the water itself to pass through the drainage structure.

2. The contaminant absorbing drainage trough apparatus of claim 1 wherein said outside wall portion includes a perpendicular support flange.

3. The contaminant absorbing drainage trough apparatus of claim 1 wherein said inside wall portion includes an oblique upper panel portion.

4. The contaminant absorbing drainage trough apparatus of claim 1 wherein said filter media portion comprises a quantity of loose filter material.

5. The contaminant absorbing drainage trough apparatus of claim 1 wherein said filter media portion comprises a filter media-filled permeable sock.

6. The contaminant absorbing drainage trough apparatus of claim 1 wherein said filter media portion comprises a filter cartridge having permeable top and bottom surfaces.

* * * * *